US008721169B2

(12) United States Patent
Schafroth

(10) Patent No.: US 8,721,169 B2
(45) Date of Patent: May 13, 2014

(54) CONTROLLER FOR A CLOCKWORK MECHANISM, AND CORRESPONDING METHOD

(71) Applicant: Team Smartfish GmbH, Stans (CH)

(72) Inventor: Konrad Schafroth, Bern (CH)

(73) Assignee: Team Smartfish GmbH, Stans (CH)

( * ) Notice: Subject to any disclaimer, the term of this patent is extended or adjusted under 35 U.S.C. 154(b) by 0 days.

(21) Appl. No.: 13/654,141

(22) Filed: Oct. 17, 2012

(65) Prior Publication Data

US 2013/0051191 A1 Feb. 28, 2013

Related U.S. Application Data

(63) Continuation of application No. PCT/EP2011/056484, filed on Apr. 21, 2011.

(51) Int. Cl.
*G04B 17/04* (2006.01)
*G04B 17/20* (2006.01)

(52) U.S. Cl.
USPC ..... 368/175; 368/171

(58) Field of Classification Search
USPC ..... 368/124, 158, 169–171, 175
See application file for complete search history.

(56) References Cited

U.S. PATENT DOCUMENTS

| | | | | | |
|---|---|---|---|---|---|
| 3,351,834 | A | * | 11/1967 | Gerum | 318/132 |
| 3,512,352 | A | * | 5/1970 | Ito | 368/167 |
| 3,616,638 | A | * | 11/1971 | Bennett | 368/159 |
| 3,657,874 | A | * | 4/1972 | Imahashi | 368/157 |
| 4,435,667 | A | | 3/1984 | Kolm et al. | |
| 5,881,027 | A | | 3/1999 | Schafroth | |

FOREIGN PATENT DOCUMENTS

| | | | |
|---|---|---|---|
| EP | 848842 | B2 | 4/2006 |
| JP | 9211151 | A | 8/1997 |
| JP | 2002228774 | A | 8/2002 |

OTHER PUBLICATIONS

International Search Report dated Jun. 27, 2011, cited in PCT Application No. PCT/EP2011/056484.

* cited by examiner

*Primary Examiner* — Vit W Miska
(74) *Attorney, Agent, or Firm* — Blank Rome LLP

(57) ABSTRACT

Controller for a clockwork mechanism, having the following components: a balance wheel; a piezoelectric helical spring (20); an electronic circuit for coordinating the stiffness of the piezoelectric helical spring (20); characterized in that the electronic circuit has a plurality of capacitors which can be switched individually (222, 224, 226, 228).

21 Claims, 8 Drawing Sheets

CONTROLLER FOR A CLOCKWORK MECHANISM, AND CORRESPONDING METHOD

RELATED APPLICATIONS

This application is a continuation of PCT/EP2011/056484, filed Apr. 21, 2011, which claims priority to 2010CH-0580, filed Apr. 21, 2010, 2010CH-0692, filed May 6, 2010, 2010CH-1298, filed Aug. 12, 2010, 2010CH-1440, filed Sep. 7, 2010, 2010CH-1454, filed Sep. 10, 2010, 2010CH-1537, filed Sep. 23, 2010, 2010CH-1824, filed Nov. 2, 2010, 2010CH-1931, filed Nov. 18, 2010, 2010CH-2132, filed Dec. 21, 2010 and 2011CH-0322, filed Feb. 24, 2011, the entire contents of which are hereby incorporated by reference.

TECHNICAL FIELD

The invention relates to a mechanical watch, whose regulating element or controller comprises a balance, a spiral hairspring and an electronic circuit with a quartz oscillator.

BACKGROUND OF THE INVENTION

Mechanical watches are powered by a mainspring. This spring is the motor of mechanical watches: it is wound up either manually or through the automatic winding-up mechanism when the watch is worn on the wrist and thus stores energy. This is then released continuously to the geartrain.

The geartrain is a kind of gearing mechanism that releases and transmits the high energy from the barrel to the small wheels (minutes wheel, third wheel, seconds' wheel and lever wheel). The escapement as connecting link between geartrain and balance provides for the transmission of the clock pulse and, through the level wheel and the pallets, releases the driving energy from the barrel to the balance and maintains the latter in oscillation. The escapement, controlled by the regulating element, frees and stops the geartrain at very accurate intervals.

The regulating element (controller) comprises a spiral hairspring and a balance wheel (balance). The balance behaves in a way similar to a pendulum, which is always returned to its resting position by means of the spiral hairspring and thus ensures the clock pulse of the watch remains even. In most modern watches, the balance oscillates at 8800 A/h, i.e. eight times per second or nearly 700,000 times per day. These intervals cause the hands to show the "correct time" on the dial.

One disadvantage of mechanical watches by comparison with electronic watches is that the running of a wristwatch is adversely affected by changes in position, fluctuating temperatures, magnetism, dust, irregular winding-up and oils.

EP848842 discloses a timepiece movement whose spring drives through the geartrain a time display and a generator supplying an AC voltage. The generator powers, via a voltage-transformer circuit, a capacitative component and the capacitative component powers an electronic reference circuit with a stable oscillator as well as an electronic control circuit. The electronic control circuit comprises a comparator-logic circuit and an energy dissipation circuit which is connected to an output of the comparator-logic circuit and whose power consumption is controllable through the comparator-logic circuit. An input of the comparator-logic circuit is connected with the electronic reference circuit and another input of the comparator-logic circuit is connected to the generator by means of a comparator step and an anticoincidence circuit. The comparator-logic circuit is designed in such a way that it compares a clock signal coming from the electronic reference circuit with a clock signal originating from the generator, then, in a manner dependent on the result of this comparison, controls the amount of the power consumption of the electronic control circuit by means of the magnitude of the power consumption of the energy dissipation circuit, and in this manner controls the movement of the generator and thus also the operation of the time indicator by controlling the power consumption of the control circuit.

The clockwork from EP848842 requires however a relatively complicated electronics, a generator supplying the energy needed for operating the electronics, as well as a relatively large space for integrating the systems. A further disadvantage of such a timepiece movement is that the forces and torques are different from those of a mechanical clockwork movement, so that the entire clockwork movement needs to be adapted.

SUMMARY OF THE INVENTION

It is an aim of the invention to propose an improved regulating element for a mechanical watch.

It is a further aim of the invention to propose a more accurate regulating element for a mechanical watch.

It is a further aim of the invention to propose an electronic regulating element for a mechanical watch, wherein the electronic regulating element is powered by the mechanical clockwork movement and without battery.

It is another aim to make available a new regulating element or auxiliary regulating element for a mechanical clockwork movement that can be integrated into an existing mechanical clockwork movement with minimal changes.

These aims are achieved with a regulating element comprising a balance, a spiral hairspring that is at least partly made of a piezoelectric material and electronics regulating the running of the balance.

According to one aspect, a regulating element resp. controller for a mechanical clockwork movement is proposed that considerably improves the running accuracy of the mechanical regulating element, by electronically stabilizing the balance oscillation frequency, wherein the energy for the electronics of the regulating element is made available by the spiral hairspring.

According to one aspect, the spiral hairspring of a conventional mechanical watch is replaced by a piezoelectric spiral hairspring. The piezo spiral hairspring generates an AC voltage depending on the oscillations of the balance and/or of the spiral hairspring.

To control the balance oscillation frequency, the AC voltage is transmitted through an electric connection to an electronic circuit that can change and thus regulate the stiffness of the spiral hairspring and thus the frequency of the balance/spiral hairspring oscillating system. Simultaneously, the electronic circuit can be powered exclusively by said piezo spiral hairspring, so that an additional battery is not required. Although a battery is not necessary, it is conceivable for the electronic circuit to be powered by a solar cell and a small accumulator or a capacitance.

When the balance is thus made to oscillate, an AC voltage is generated through the piezoelectric materials applied to the spiral hairspring. The spiral hairspring thus functions as a small generator. The AC voltage at the output of the spiral hairspring is commutated in order to power the electronic circuit.

The stiffness of the spiral hairspring is adapted by changing the impedance at the output of the piezo spiral hairspring. In a preferred embodiment, this is achieved by adapting the value of a capacitance in parallel to the piezo spiral hairspring. The higher the value of the capacitance connected in parallel to the piezo spiral hairspring, the smaller the stiffness of the spiral hairspring. In one preferred embodiment, the adjustable capacitance comprises a number of capacitances that can be connected and cut off by means of switches.

An example of a piezoelectric helical spring has been described by Tao Dong et al. in "Proceedings of PowerMEMS 2008+ micro EMS 2008", Sendai, Japan, November 9-12: "A Mems-based spiral piezoelectric energy harvester"; this spiral hairspring is however not used as a regulating element for a clockwork movement and the oscillation frequency is not adjusted electronically.

U.S. Pat. No. 4,435,667 describes an actuator with a piezoelectric spiral; this actuator is not used for a clockwork movement.

JP2002228774 (Seiko Epson Corp) describes a method for adjusting the oscillation frequency of a piezoelectric helical spring, in which the piezo-element is either connected with an electric circuit or is completely separate from this circuit. This however results in abrupt changes of the impedance connected with the spiral hairspring, each time when the electric circuit is connected with the piezo-element or is separated from this circuit. Such fast impedance changes with a wide amplitude abruptly modify the electric voltage at the input of the electronic circuit. The greater the capacitance connected in parallel to the piezo spiral hairspring is, the smaller the induced AC voltage is at the input of the commutator. This can result in the voltage at the input of the electronics not being high enough to ensure the electronics operate effectively. Another problem is that in this embodiment, the balance oscillates either too fast or too slowly but never at the correct frequency. This can also cause problems with the regulating and even lead to undesirable oscillations. This has proven detrimental in terms of precision.

In a preferred embodiment of the present invention, the capacitance at the output of the piezo electric hairspring is adjusted in several steps, in order, on the one hand, to be able to change the stiffness of the spiral hairspring in small steps and, on the other hand, to only connect the minimal capacitance required in parallel to the piezo spiral hairspring so that the voltage at the input of the commutator is not unnecessarily lowered. In a preferred embodiment, at least one permanent small capacitance in the electronic circuit is continuously connected with the piezo electric hairspring. This has the advantage that the voltage at the input of the commutator can be adjusted in such a way that the commutator functions effectively and exhibits a high degree of efficiency.

According to another independent aspect of the invention, in order to adjust the impedance at the output of the spiral hairspring, the electronic circuit comprises an active commutator, in which diodes are replaced by transistors, and/or a circuit with several transistors for adapting the impedance at the output of the spiral hairspring; at least some of these transistors are controlled with an increased voltage, for example with a voltage that is higher than the voltage of most of the digital components of the electronic circuit. Controlling the switches can be achieved for example with level shifters; this allows the ohmic resistance in these switches to be reduced.

The voltage for controlling the transistors in the commutator and/or in the impedance adjuster circuit is thus higher than the feed voltage Vdd of the electronic circuit, with which the digital component or most of the digital components of the electronic circuit are controlled. This reduces the power consumption of the electronic circuit and the transistors have a smaller ohmic resistance.

The transistors for adjusting the impedance at the output of the spiral hairspring are only switched on or connected when the voltage induced by the spiral hairspring is lower than a predetermined threshold or when the current generated by the spiral hairspring is lower than a predetermined threshold. It is thus possible in this way to reduce energy losses.

Further advantageous embodiments are indicated in the dependent claims.

BRIEF DESCRIPTION OF THE FIGURES

The invention will be described in more detail on the basis of the attached figures, in which.

DETAILED DESCRIPTION OF THE PREFERRED EMBODIMENTS

Figure 4:
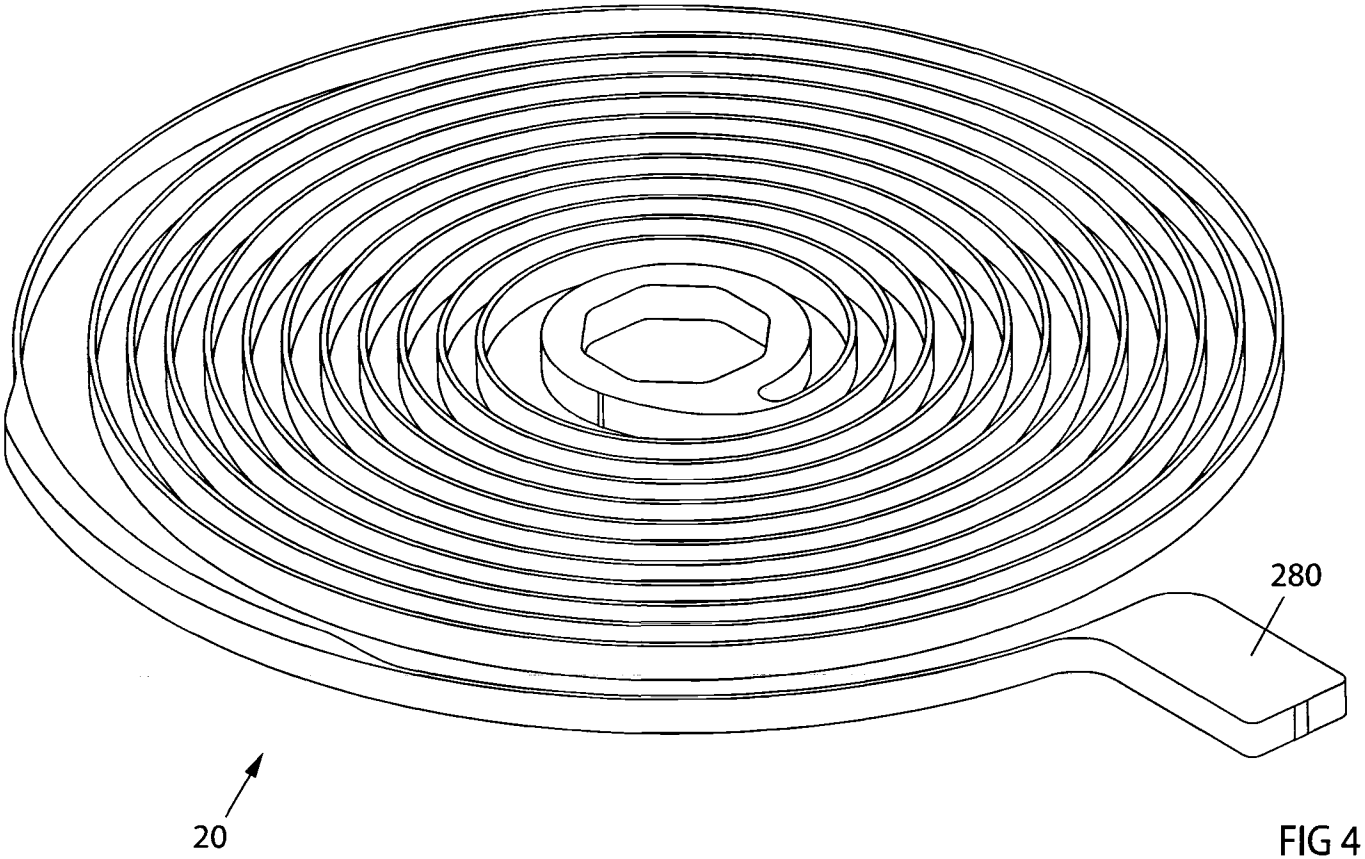
FIG. 4 shows a diagrammatic view of a spiral hairspring.
Figure 5A:
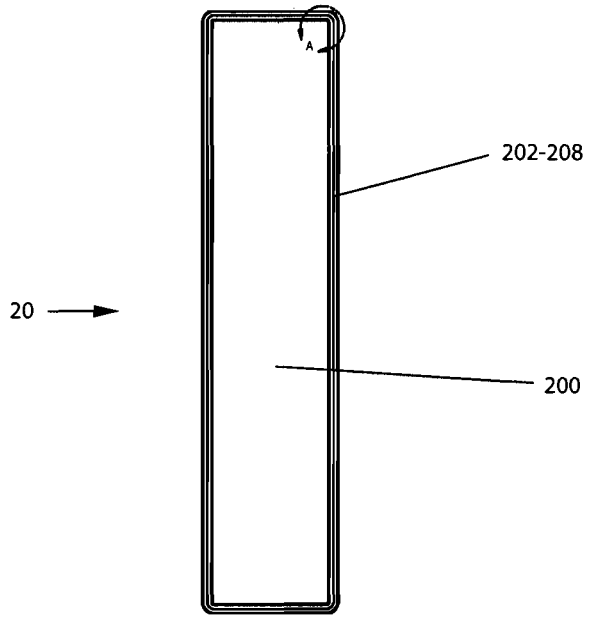
FIG. 5*a* shows a diagrammatic view of the cross section of an inventive spiral hairspring.
Figure 5B:
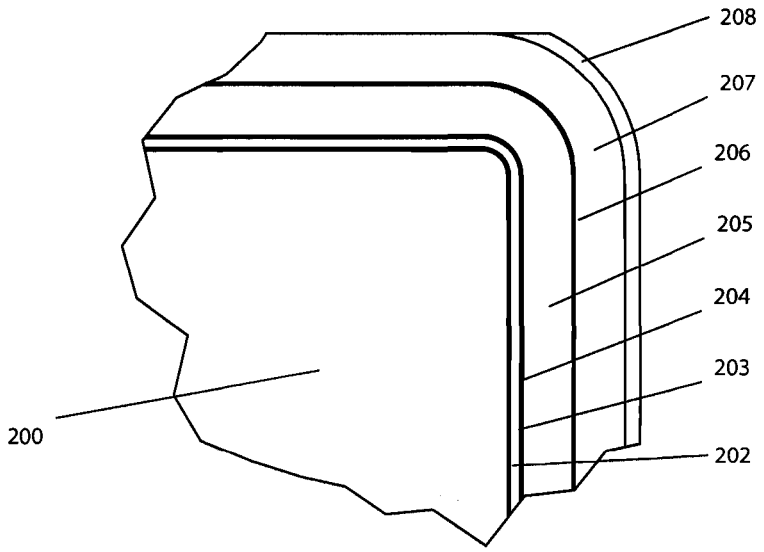
FIG. 5*b* shows a detail of the cross section of the spiral hairspring with the different layers.
Figure 6:
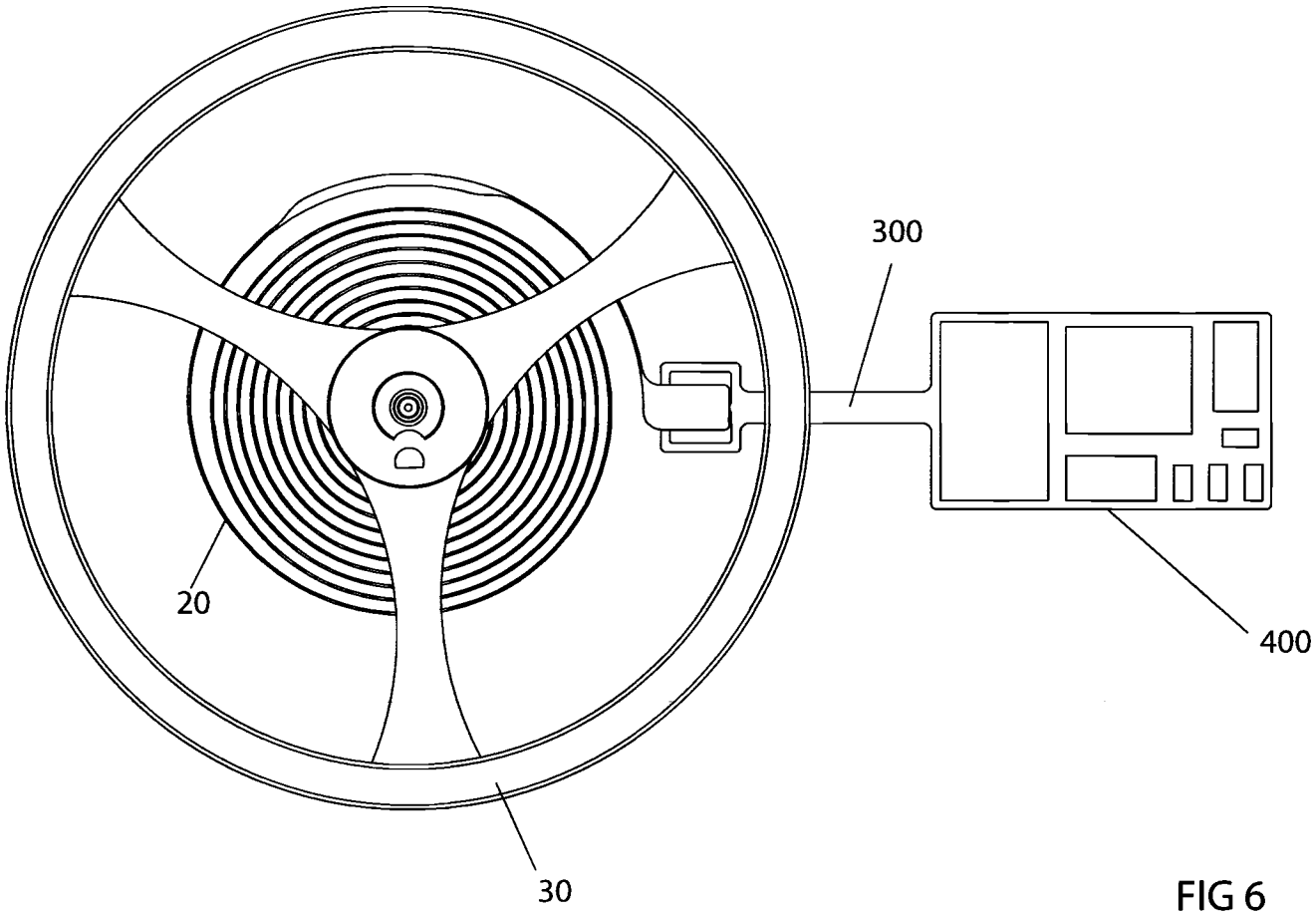
FIG. 6 shows a diagrammatic view of the balance, the piezo spiral hairspring and the electronic circuit.

A regulating element according to the invention comprises a conventional balance 30, a piezoelectric spiral hairspring 20 (FIGS. 4, 5*a* and 5*b*) and an electronic circuit 40 for controlling the precision of a mechanical clockwork movement with a piezo electric hairspring. This regulating element is connected in a conventional manner through an escapement (not represented) with the geartrain of a mechanical clockwork movement supplying the required energy and whose running can thus be controlled.

The piezoelectric spiral hairspring 20 consists of a piezoelectric material or of a material at least coated with a piezoelectric layer, preferably of a Semiconductor material (for example silicon) 200, which is at least partly (FIG. 5*a* and FIG. 5*b*) coated with a piezoelectric material 202-207 and an electrode 208. Number 202 refers to a seeding layer, 203 and 204 are intermediary layers of AlGaN resp. AlN, 205 is a semiconductor layer (for example of GaN), 206 is an intermediary layer of AlN, 207 is a further piezoelectric layer of GaN for example and 208 is an electrode. The piezo spiral hairspring is advantageously made as dimorphic piezo-element, but other embodiments are also conceivable.

The piezoelectric spiral hairspring can be made for example from a wafer, for example from a silicon wafer. By accordingly using a nitrogen or phosphorous-doped silicon 200, the wafer has good electric conductivity and the core of the silicon piezo spiral hairspring can be used directly as electrode.

The spiral hairsprings are structured on the wafer. With the Deep Reactive Ion Etching DRIE process, vertical structures can be made of silicon in a simple and easy manner.

After the spiral hairsprings have been structured on the wafer, a thin oxide layer of a size on the order of 1-3 μm is formed on the surface of the spiral hairsprings through controlled oxidation of the wafer. Edges are then rounded and any unevenness in the vertically etched surfaces is smoothed.

This oxide layer is then etched away, in order on the one hand to ensure a good electric contract between the conductive core 200 of the spiral hairspring and the piezoelectric layer 205, 207, and on the other hand to achieve a good quality of the piezoelectric layer.

Subsequently, on a seeding layer 202 of AlN at least one piezoelectric layer 205, 207 is applied at the desired layer thickness onto the wafer and thus onto the spiral hairspring without an oxide layer, for example an aluminum nitride layer. This layer 205, 207 ideally has an identical thickness all over the spiral hairspring. This makes it possible to prevent the spiral hairspring from deforming in an undesirable manner under the different thermal expansion coefficients of the silicon and of the piezo material.

After the application of the piezoelectric layer(s), the electrodes 208 are then applied. One possibility consists in first coating the entire wafer with a thin adhesive chromium or titanium layer of a thickness of a few nm, after which a layer 208 for example of nickel or nickel/gold is applied in a thickness of 100-500 nm. The entire wafer and also the spiral hairsprings on the entire surface are thus coated everywhere with an electrically conductive layer.

After the electrodes 208 have been applied, a targeted etching process will remove the electrode material on the upper and lower side of the wafer, so that only the electrodes 208 remain on the vertical lateral sides of the spiral hairspring. After a predetermined breaking point on the spiral roll and a predetermined breaking point on small blocks have been broken, the electrodes 208 on the inner side and on the outer side of the spiral hairspring are separated from one another and the spiral hairspring is ready to be built into the clockwork movement.

This piezoelectric spiral hairspring is then mounted instead of a conventional spiral hairspring in a mechanical clockwork movement. When the piezoelectric spiral hairspring 20 oscillates, the piezo material generates an electric output signal $V_{gen}A$-$V_{gen}B$, which powers an electronic circuit 40 on a circuit board 400. By changing an impedance that is connected in parallel to the spiral hairspring 20, the stiffness of the piezo spiral hairspring can be changed and thus the oscillation frequency of the piezo electric hairspring and of the balance can be adjusted by the electronic circuit 40.

Figure 1:
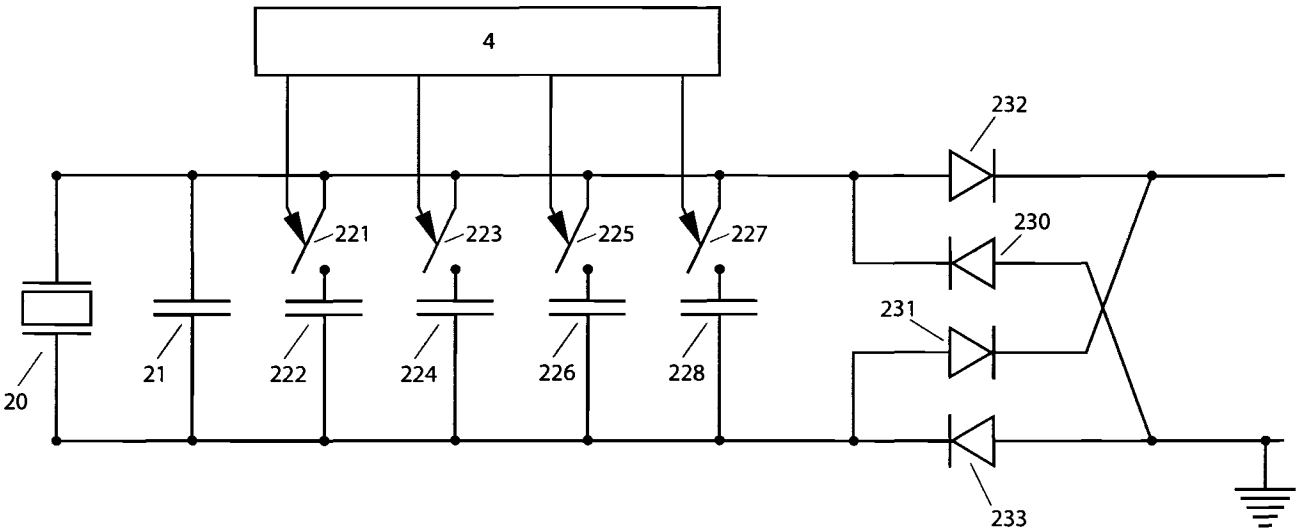
FIG. 1 shows a diagrammatic view of the regulating assembly resp. controller, represented with the capacitances, the switches connecting and cutting off the capacitances as well as the comparator-logic circuit controlling the switches.
Figure 2:
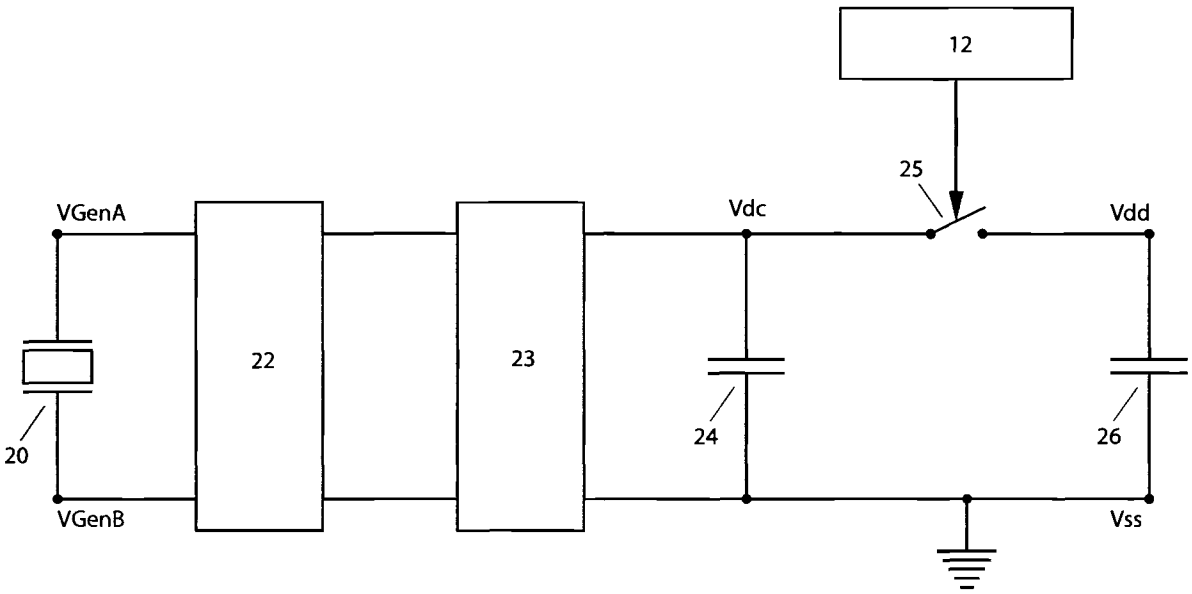
FIG. 2 shows a diagrammatic view of the controller for adjusting the voltage of the capacitor supplying the electronic circuit with energy.
Figure 7:
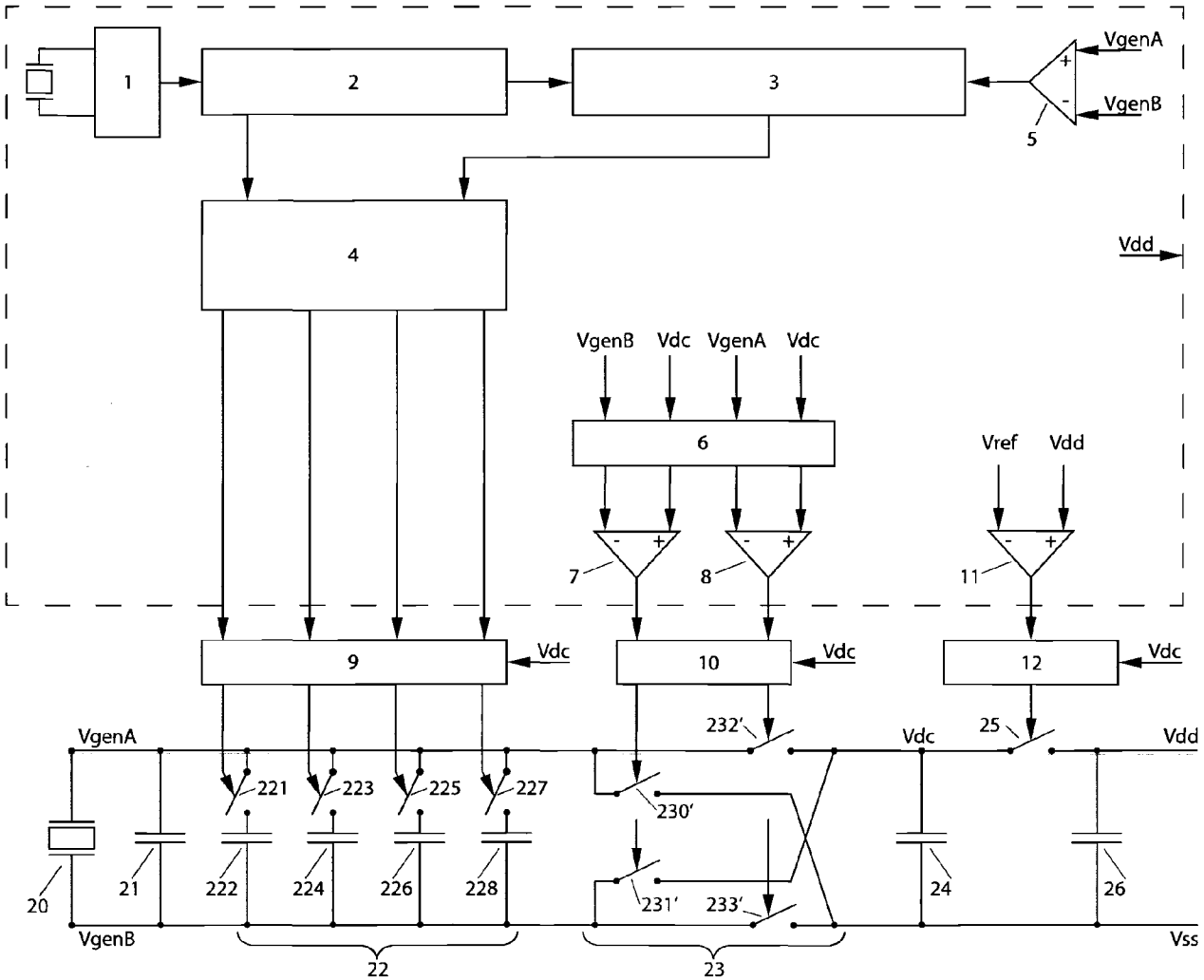
FIG. 7 shows a diagrammatic view of the electronic circuit, wherein the switches for the frequency controller and the active commutator as well as the switches for the voltage controller of the second capacitance are controlled through level shifters.

An example of an electronic circuit 40 for controlling the oscillation frequency of a piezo electric hairspring 20 is represented in FIG. 2 and, in more detail, in FIG. 7, 8. Two electrodes are connected with the piezo material on the piezo spiral hairspring 20 and supply an AC voltage $V_{gen}A$-$V_{gen}B$. The spiral hairspring thus functions as a small generator.

The frequency of the output signal $V_{gen}A$-$V_{gen}B$ is controlled by a frequency adjuster circuit 22, so that the running of the mechanical clockwork movement is controlled.

A commutator circuit 23 (rectifier) converts the AC voltage into a DC voltage $V_{dc}$ and a voltage adjuster circuit with the transistor 25 controls the voltage $V_{dd}$ of a capacitance through which the electronic circuit 40 is then powered. A first capacitive component element 24 is preferably used as energy storage or energy temporary storage device. The first capacitive component element 24 feeds the electronic reference circuit with a stable quartz oscillator 1 and a frequency divider 2, either directly or through a second capacitive component element 26 that is maintained on a regulated voltage. The stable oscillator has a crystal oscillator whose oscillations define a reference frequency. All components apart from the crystal oscillator and the external capacitances can be assembled as an IC 40; most digital components in the IC can be powered with a low feed voltage $V_{dd}$.

Since the AC voltage that can be generated with a piezo element 20 can be relatively high, no voltage multiplier is required for powering the IC 40.

The electronic circuit 40 can only further reduce the frequency of the balance.

Adjusting/Controlling the Frequency

On the one hand, the oscillation frequency of the balance and piezo spiral hairspring 20 can be influenced in that the piezo spiral hairspring 20 must deliver much electric power. This can occur for example by connecting an ohmic resistance in parallel to the piezo spiral hairspring or by connecting an ohmic resistance in parallel to the first capacitor 24 which is powered by the piezo spiral hairspring through the commutator 23. The disadvantage of this solution is, however, on the one hand that the frequency change is only small, on the order of 0.5% or less, and on the other hand that the oscillation amplitude of the balance becomes very small, since the ohmic resistance will cause continuous loss of energy.

A considerably greater frequency modification in the combination of balance and piezo spiral hairspring can be achieved when the impedance-changing circuit 22 varies the capacitance that is connected in parallel to the piezo spiral hairspring 20. The greater the capacitance, the smaller the stiffness of the piezo spiral hairspring 20 and thus the oscillation frequency of the system. Frequency changes on the order of 1-2% can be achieved in this manner. This corresponds to a feasible correction of 10-20 minutes per day.

In a variant embodiment, not represented, both electric connections of the piezo spiral hairspring 20 are each connected to ground, wherein at least one capacitance is being varied.

In one embodiment, the electronic control circuit 40 has a comparator-logic circuit 4, of which one input is connected with the electronic reference circuit 1, 2 and the other input is connected through a comparator step 5 detecting the zero crossing of the AC current $V_{gen}A$-$V_{gen}B$ and an anticoincidence circuit 3. The anticoincidence circuit 3 is essentially a temporary storage element that prevents pulses to enter simultaneously on both inputs of the comparator-logic circuit 4. An output of the comparator-logic circuit 4 controls the connecting to and cutting off of the capacitances in the impedance-changing circuit 22.

The impedance-changing circuit 22 consists in this example of a plurality of similar smaller capacitances 21, 222, 223, 224, 226, 228 (capacitors). The capacitances can however also have different values, for example the capacitances can be chosen in such a way that the smallest capacitance has a value of 1 nF, the second capacitance a value of 2 nF, the third capacitance a value of 4 nF and the fourth capacitance a value of 8 nF. The comparator-logic circuit 4 controls the impedance of the impedance-changing circuit 22 by changing the number or the combination of the capacitances connected in parallel to the piezo spiral hairspring 20. In this manner, the impedance of the electronic control circuit 40 can be controlled in small steps within a range of values predetermined by the number and the value of the capacitances.

The comparator-logic circuit 4 compares a clock signal A coming from the electronic reference circuit 1, 2 with a clock signal B coming from the piezo generator. Depending on the result of this comparison, the comparator-logic circuit 4 controls the size of the impedance of the electronic control circuit through the number or the combination of the capacitances 21, 222, 224, 226, 228 connected in parallel to the piezo spiral hairspring 20. In this manner, by controlling the impedance, the running of the piezo spiral hairspring 20 and the balance and thus the running of the time display is controlled. The controller is designed in such a way that the running of the time display is synchronized in a desired manner with the reference frequency supplied by the quartz oscillator 1.

In order to make a control circuit that is as energetically efficient as possible, it is useful to execute the comparator-logic circuit 4 by means of counters, not represented.

One possibility consists in connecting the one input of an up-down counter with the output of the comparator 5 that detects the phase $V_{gen}A$, $V_{gen}B$ of the induced voltage of the piezo spiral hairspring 20, e.g. the zero crossing of the AC voltage; and in connecting the other input of the up-down counter with the reference circuit 1, 2. The signals from the comparator 5 are added to the counter reading, and the signals from the reference circuit 1, 2 are subtracted. The value counted by the counter thus corresponds to the difference between the number of pulses from the piezo spiral hairspring 20 and the number of pulses from the reference circuit 1, 2.

The incoming signals received by the counter in the comparator-logic circuit 5 are synchronized with the anticoincidence circuit 3 in such a manner that an UP pulse from the comparator 5 and a DOWN pulse from the reference circuit 1, 2 arrive simultaneously at the counter.

If both frequencies are identical, the counter reading will only ever increase by one step, as soon as the UP signal from the comparator (which for example measures the zero crossing of the voltage induced by the piezo spiral hairspring) is received by the counter, and will again decrease by one step, as soon as the DOWN reference signal from the reference circuit 1, 2 is received. If the balance then oscillates too fast, in time more UP pulses will be received than DOWN pulses and the counter reading will increase. In a simple embodiment, switches 221, 223, 225, 227 (transistors) can be controlled directly from the output of the counter and they will connect or cut off the capacitances 222, 224, 226, 228 in parallel to the piezo spiral hairspring 20. The greater the phase shift, the greater the counter reading and the more capacitances are connected in parallel to the piezo spiral hairspring 20. However, the greater the impedance connected in parallel to the piezo spiral hairspring 20, the more the oscillation frequency of the balance is slowed down.

In order for the controller to be able to function effectively during short-term disturbances, when for example the oscillation frequency of the balance is temporarily too low due to a shock, below a determined counter reading none of the disconnectable capacitances 222, 224, 226, 228 is connected in parallel to the piezo spiral hairspring 20. This can be achieved for example by having no capacitance (or only the permanent capacitance 21) connected in parallel to the piezo spiral, hairspring 20 for the counter steps 0-7 but having the corresponding number or combination of capacitances connected in parallel for counter readings of 8-15, i.e. at counter step 8 an additional capacitance is connected in parallel to the piezo spiral hairspring, at counter step 9 two additional capacitances are connected in parallel, at counter step 10 three etc., if capacitances with same-size capacitance values are used.

If capacitances with binary capacitance values are used, the switches 221, 222, 225, 227 for connecting or cutting off the capacitances 222, 224, 226, 228 can be controlled directly from the binary counter in the comparator-logic circuit 4. With this principle, a simple embodiment of a controller can be made that additionally uses very little power. Admittedly, a seconds' hand can then deviate by up to 1 s, since the maximum number of capacitances in this example is only connected when the counter has received 7 UP pulses more than DOWN pulses. 8 UP pulses however correspond to one second on the dial, if a balance with 4 Hz is used.

The size of the counter in the comparator-logic circuit 4 can be freely chosen, however a counter will reasonably be used with which a range of +/−2-4 seconds can be covered.

Loss-Free Switching of the Capacitances

Ideally, the capacitances 222, 224, 226, 228 are only connected or cut off when the induced voltage at the output of the piezo spiral hairspring 20 is very small or is equal to 0. This has the advantage on the one hand that the electric losses can thus be minimized. A further advantage is that the polarity of the capacitances does not need to be determined and/or previously stored. Yet another advantage is that per capacitance 222, 224, 226, 228 only one switch 221, 223, 225 resp. 227, consisting of a P-channel and an N-channel transistor connected in parallel, is required. The capacitances can all be connected together with the one electric connection, it is only for the other respective connection that one switch each per capacitance is required. On the one hand, it is thus possible to minimize the electric resistance and, on the other hand, fewer outputs for the switching transistors 221, 223, 225, 227 need be provided. This enables the construction of a smaller printed circuit 400 and also the use of a chip 40 with fewer connection pads.

The switching over of the capacitances during zero crossing (when the voltage induced by the piezo electric hairspring 20 is 0 or is only a few mV) can be achieved by synchronizing the switching process with the zero crossing comparator 5 that detects the zero crossing of the voltage at the output of the spiral hairspring. From the comparator-logic circuit 4, the information about the combination of the capacitances to be connected is supplied and at the next change of sign of the generator voltage, the switches 221-227 for the connecting of the capacitances 222-228 are controlled with this information, until the next sign change of the voltage supplied by the piezo generator 20 when the switches for the next cycle is controlled with the information from the comparator-logic circuit.

It is also possible to connect or cut off the capacitances 222-228 during the charging of a first capacitance 24 at the output of the commutator 23. The voltage $V_{gen}A$-$V_{gen}B$ supplied by the piezo generator 20 is then practically constant over a certain time span, since the charging capacitance 24 is charged and the internal resistance of the piezo spiral hairspring 20 is very high. If a small capacitance 222 to 228 with the correct polarity is then connected, this does not change the induced voltage. Thus no current will flow and no energy is withdrawn from the system.

The connecting of the capacitances 222 to 228 must in this case by synchronized with the charging process. The comparator-logic circuit 4 determines the combination of the capacitances to be connected thereto, and during the next charging process, this combination of capacitances is connected to the piezo spiral hairspring.

In order to be able to avoid or minimize the charge-transfer losses, the capacitances 222 to 228 must however in this embodiment be connected with the correct polarity. The polarity used can either be stored or be determined by means of additional comparators. One disadvantage of this solution, however, is that per capacitance 222 to 228 two switches each then need to be used. This means that per capacitance 2 outputs are needed at the integrated circuit 40, and the number of the conductor paths on the printed circuit 400 will also be correspondingly greater.

Put simply, the capacitances 222 to 228 are then ideally connected in parallel to the piezo spiral hairspring 20 or cut off when the voltage at the piezo spiral hairspring 20 and the voltage at the corresponding capacitance 24 are about the same and, if this voltage is more than a couple to some dozen mV, the polarity also needs to be the same.

Regulating Assembly Resp. Controller with 2 Counters

Another, more elegant, solution for the regulating assembly/controller can be made on the one hand by combining a counter in the comparator-logic circuit 4, as described above, with a second small counter. When the counter reading of the large counter is between 0 and 7, no capacitances 222 to 228 are additionally connected in parallel. For a counter reading between 7 and 8, the number of the capacitances connected in parallel is determined by the small counter. And when the counter reading of the large counter is greater than 8, all available capacitances are connected in parallel to the piezo spiral hairspring 20.

In this embodiment, the phase shift between the UP pulse from the piezo spiral hairspring 20 and the subsequent DOWN pulse from the reference circuit are measured with the small counter. The greater the phase shift is, i.e. the greater the time span between the UP pulse and the DOWN pulse, the greater then is the value of the combination of the capacitances that are connected in parallel to the piezo spiral hairspring.

The small counter is operated for example at 64 Hz. At each UP pulse, the counter is started at 0, and the counter is stopped by the subsequent DOWN pulse. The value at the output of the small counter after the DOWN pulse has been received is stored temporarily and at the next zero crossing of the AC voltage, when again and UP pulse is generated, together with the temporarily stored value from the small counter the corresponding combination of capacitances is connected in parallel to the piezo spiral hairspring. For a counter reading of 1-7, no capacitance (or only the permanent capacitance 21) is connected, for a counter reading of 8-15 an additional capacitance is connected, for a counter reading of 16-23 a second additional capacitance is connected etc. (if the capacitances all have the same size). The regulation in this case also takes place in the range of ⅛ of a second, which is barely noticed by the watch user for whom the watch will always display the exact time.

The small counter can however also be operated at a considerably higher frequency, for example at 1024 Hz. With each UP pulse, the counter is started at 0, and with the DOWN pulse the counter is stopped and the value of the counter reading is temporarily stored, so as to connect at the next UP pulse the corresponding combination of capacitances in parallel to the piezo spiral hairspring 20.

Adjusting the Induced Voltage

If a capacitance 21, 222, 224, 226 or 228 is connected in parallel to the piezo spring, the induced voltage at the output of the piezo spiral hairspring 20 is affected, as described further above. A large capacitance will yield a small induced voltage, a small capacitance or no capacitance connected in parallel to the piezo spiral hairspring 20 will yield a large voltage at the input of the commutator 23. The voltage $V_{gen}A$, $V_{gen}B$ induced by the piezo spiral hairspring 20 can thus be adjusted by means of a capacitance 21 connected in parallel to the piezo spiral hairspring 20. This can, on the one hand, be necessary in order for the induced voltage to be in a range favorable for the electronics 40. The induced voltage may not be too high, since otherwise flyback diodes at the inputs of the IC 40 are connected, which results in an energy loss. On the other hand, the induced voltage should be higher than the minimal operating voltage required for an effective functioning of the electronic circuit.

With a capacitance 21 connected in parallel to the piezo spiral hairspring 20, the desired induced voltage can be adjusted. A first small capacitance 21 with a value of 1-10 nF can be permanently connected in parallel to the piezo spiral hairspring, in order for the voltage at the input of the commutator 23 to be in the desired range and not exceed a maximum value.

It is also conceivable to use only one, but instead a large capacitance for controlling the frequency of the balance. This capacitance must be sufficiently large for the frequency of the balance/spiral hairspring with connected capacitance to be in any case smaller than the nominal frequency. However, since it is not yet known how large the capacitance needs to be, this capacitance must be chosen rather too big. This however has the disadvantage that the induced voltage of the piezo spiral hairspring when connecting the capacitance becomes considerably smaller, depending on the piezo spiral hairspring and the used capacitance, which makes it difficult to ensure the energy supply of the electronic circuit. The voltage at the input of the commutator can even become so low that an effective operation of the electronic circuit can no longer be ensured.

It is thus advantageous to use more than just one capacitance for the regulating assembly resp. controller. Only the capacitance value that is needed is then connected in order to maintain the correct oscillation frequency of the balance/spiral hairspring, and the induced voltage at the input of the electronic adjuster circuit is not unnecessarily lowered.

Active Commutator

The electronic circuit 40 must be capable of being operated with minimal energy consumption. This is achieved by replacing at least one passive component element (for example a diode for the commutator) of the commutator circuit 23 at least part of the time with an active component unit (for example a switch controlled by means of a comparator 7 or 8) 230', 231', 332', 233' with a smaller electric resistance in forward-biased direction.

The switch 230', 231', 232', 233' can be a field effect transistor and be connected in such a way that in its locked state, part of its structure operates as a diode. In this manner, active switches replace all four diodes of the commutator 23. Voltage losses over the switch are lower by at least one order of magnitude than the voltage losses over the diode. The voltage drop over a diode can be several hundred mV. The voltage drop over the channel of a field effect transistor however is only a few mV.

The charging of the first capacitance 24 takes place in the initial start-up phase of the clockwork movement through the diodes associated with a high voltage loss. Subsequently, as soon as the comparators 7, 8 are operational, the diodes are then replaced with the active component elements so that the voltage loss can be minimized, which is considerably more favorable in terms of energy than charging over the diodes. In this manner, the energy reserve of the clockwork movement is used more sparingly and the power reserve is increased.

The charging of the first capacitive component element 24 thus only takes place in the start-up phase of the clockwork movement through the diodes associated with a high voltage loss.

The first comparator 7 compares the electric potential $V_{dc}$ at the connection that is not to the ground potential of the first capacitive component element 24 with the electric potential $V_{gen}B$ of the connection that is at the load end and not to the ground potential of the commutator 23. The first switch 230' is only then closed by the first comparator 7 if the voltage of the first capacitive component element 24 is sufficient for operating the first comparator 7 and the electric potential $V_{dc}$ at the connection that is at the load end and not grounded of the commutator 23 is sufficiently high for further charging the first capacitive component element.

The voltage value of the first capacitive component element 24, which is sufficient for operating the first comparator 7 and for operating a second comparator 8 available in the commutator 23, is in this example of embodiment 0.7 V. As soon as the first capacitive component element 23 is charged over the passive component elements (diodes) to at least 0.7 V, the current source will function and thus also the comparators 7, 8. The first comparator 7 closes as soon as the voltage $V_{gen}B$ supplied by the piezo spiral hairspring is higher than the voltage $V_{dc}$ of the first capacitive Component element 24, i.e. it closes the first switch 230' resp. opens the first field effect transistor. As soon as the voltage $V_{genB}$ supplied by the piezo spiral hairspring 20 again falls below the voltage $V_{dc}$ of the first capacitive component element 24, the first comparator 7 closes the first field effect transistor 230'. If the voltage $V_{genB}$ supplied by the piezo spiral hairspring 20 climbs again to a sufficiently large value, the first comparator 7 opens the first field effect transistor 230' again and so on. The voltage drop over the channel of the first field effect transistor 230' however amounts to only a few mV by comparison to the diodes. The efficiency of the commutator with the active elements is thus considerably higher than that of a commutator 23 with passive elements. Using an active commutator thus considerably reduces the voltage loss.

If however only small voltages and currents are switched, it can happen that a vibration or chatter of the comparator/switch combination may develop. The comparator 7 (or 8) measures a voltage difference, but as soon as the switch 230' is closed, the voltage drop over the switch 230' is so small that the comparator 7 opens the switch again. As soon as the switch is open, the comparator detects again a voltage difference and the switch is again closed. The switch/comparator system can thus vibrate, which in an extreme case can result in the capacitive component element not being charged with sufficient voltage in order to ensure the operation of the electronic circuit. In any case, the efficiency of the commutator 23 will deteriorate if the comparator/switch system starts to chatter or vibrate.

This can be prevented on the one hand by using comparators 7, 8 with a sufficiently large offset and a sufficiently large hysteresis. This also has the advantage that the piezo generator 20 is always connected in one way or the other with the first capacitance through a switch having a more or less large internal resistance, as soon as the induced voltage of the piezo spiral hairspring 20 is greater than the voltage at the first capacitance.

Another possibility for avoiding this effect is to measure during the time T1 (measuring phase) with the comparator 7, 8 whether the switch 230' (resp. 231', 232', 233') needs to be closed or can remain open. If the comparator 7 (or 8) determines a voltage difference in which the voltage generated by the piezo generator before the transistor is greater than the voltage of the capacitive element, the switch is closed during the time T2 (switching phase).

The switch 230' (resp. 231', 232', 233') is subsequently opened again and the comparator 7, 8 measures again during the time T1 whether the switch needs to be closed or can remain open during the next time T2. In this way, it is possible to avoid chattering or vibrating of the active diodes.

Said control circuit comprises at least one storage means that stores in the first phase (T1, measuring phase) with a closed switch at least one control signal that is to be used on said switch, wherein later in the second phase (T2, switching phase), said switch is controlled by means of said control signal.

In case the voltage supplied by the piezo generator 20 is not high enough after completion of the commutation with the active commutator 23 for supplying the electronic circuit 40 with sufficiently high voltage, it is possible to use instead of the simple commutator 23 a voltage-converting circuit with a commutator, for example a voltage doubler circuit. This however entails the small disadvantage that more than one external capacitive element is then needed, which results in a increased space requirements for the electronic circuit.

The commutator 23 could however also consist only of passive diodes.

Minimal Current Consumption/Maximum Amplitude Independence

The oscillation amplitude of the balance of a mechanical watch can experience relatively wide variations. When the mainspring is wound up completely, a large drive torque is transmitted from the lever wheel over the lever to the balance. In this case, the balance has a great oscillation amplitude. A relatively high voltage is generated by the piezo spring in this case. If only a little drive torque is transmitted to the balance, for example if the mainspring is only wound up a little, the oscillation amplitude of the balance and thus also the voltage generated by the piezo spring will accordingly be relatively small.

It is however necessary to operate the electronics with a power consumption that is as small as possible even at different levels of AC voltages from the piezo spiral hairspring 20.

A first possibility consists in operating at least an essential part of the electronics 40 on the integrated circuit 400 with a regulated voltage, for example the quartz oscillator 1 and the frequency divider 2, the anticoincidence circuit 3 and the comparator-logic circuit 4, the comparators 5 and 11, possibly also the comparators 7, 8. This will ensure that even at high voltages at the first capacitance 24, the IC 40 can be operated with minimal power consumption. This has the advantage that even with a large amplitude of the balance and thus a large induced voltage from the piezo generator 20 and thus a high voltage at the output of the commutator 23, the power consumption of the IC will not be considerably increased.

A second possibility consists in regulating the feed voltage for the integrated circuit 40. The easiest way is by regulating the voltage of the capacitance 26 that feeds the electronics. By means of the (active) commutator 23, the electric voltage $V_{gen}$ generated by the piezo spring 20 is commutated and the capacitance is charged. The voltage from $V_{dd}$ can be regulated in that, from a particular level of $V_{dd}$ onwards, the commutator is switched off and the capacitance no longer charges, although the voltage from the piezo generator at that moment is higher than the voltage at $V_{dd}$. A possible upper ceiling for the $V_{dd}$ could for example be 1.2V.

A third possibility consists in feeding a first capacitance 24 through the commutator 23. This first capacitance 24 in this case is always charged over the commutator 23 with the electric power supplied by the piezo spiral hairspring 20. A second capacitance 26 is available for feeding the electric circuit 40. This second capacitance 26 is then regulated on a particular voltage $V_{dd}$. This can be done for example by having a switch 25 establish at certain intervals, for example 8× per second, an electric connection between the first capacitance 24, which has a voltage between 1.2 and 5V, and the second capacitance 26 if after the charging process the voltage at the second capacitance 26 falls below the desired value $V_{dd}$. As soon as the desired voltage, for example 1.2V, has been achieved at the second capacitance, the charging process is interrupted. Alternatively, a lower voltage $V_{low}$ and an upper voltage $V_{high}$ can be defined. If the voltage at the second capacitance is lower than $V_{low}$, the switch between the first and the second capacitance will be closed and the second capacitance will be charged from the first capacitance. If the voltage at the second capacitance 26 then rises above the value of $V_{high}$, the switch 25 is then opened again.

A fourth possibility consists in varying the length of the charging time window, i.e. the time during which the capacitance 26 that supplies the feed voltage $V_{dd}$ for the integrated circuit can at all be charged. The higher the $V_{dd}$ is, the shorter the charging time window. A small charging time window will yield a relatively small $V_{dd}$ even at high input voltages from the piezo generator. In this manner, the height of the voltage at the capacitance 26 can also be limited.

A further advantage of regulating the feed voltage for the integrated circuit 40 is that the piezo spiral hairspring 20 no longer needs to be adapted so accurately to the electronics 40. The piezo spiral hairs ring 20 when in operation need only supply a minimal voltage $V_{gen}$ that is sufficient for being able to operate the electronics 40 effectively and for regulating or controlling the operation of the balance. If the piezo generator 20 supplies a voltage that is greater than that needed for effective operation, this will not cause the power consumption of the electronics to be higher.

Controlling the Switching Transistors 230', 231', 232', 233' for the Commutator 23 with a Voltage Higher than the Feed Voltage Vdd of the IC 40

In order to be able to use the control signals for controlling the electronic circuit elements/transistors 230', 231', 232', 233' on the part of the electronic circuit with the higher voltage, these signals from the part of the electronic circuit 40 with the lower voltage need to be brought to a higher voltage $V_{dc}$ by means of level shifters.

The analog circuit with current sources and oscillator 1 as well as comparators 5, 7, 8, 11 and the logic circuit 4 as well as the frequency divider 2 and the anticoincidence circuit 3 is fed with a lower voltage $V_{dd}$, for example 200 mV above the minimum voltage at which the electronic circuit 40 still operates effectively.

The switches 230', 231', 232', 233' in the commutator 23, the switches 221, 223, 225, 227 for changing the impedance (by connecting or cutting off capacitances 222-228), for feeding the level shifters 9, 10, 12 as well as the switches 25, required for supplying the low-voltage part of the circuit, are operated with a higher voltage $V_{dc}$, typically between 1.2 and 5V.

If the feed voltage for the integrated electronic circuit 40 is regulated, for example at 1.0V, by setting the second capacitance 26 to this voltage but the induced voltage at the piezo spiral hairspring 20 is higher than the 1.0V and the first capacitance 24 is charged for example to 5V, the switching transistors 230', 231', 232', 233' in the commutator 23 must also be controlled with 5V. This can be done by bringing the control signal for the switching transistors 230', 231', 232', 233' by means of level shifters 10 to about the same voltage as the voltage to switch. The level shifters in this case are powered by the first capacitance 24 that is charged from the piezo generator 20.

In the event that the first capacitance 24, which is charged directly by the piezo spiral hairspring 20 over the active commutator 23, is maintained at about 1 V, by interrupting the charging process as soon as the desired voltage $V_{dc}$ has been reached, the transistors 230', 231', 232', 233' in the commutator must however be controlled with a voltage that is about the same value as the voltage to switch coming from the piezo generator. This can be achieved by providing internally a voltage increase circuit, for example a voltage doubler or voltage quadrupler. The logic signals that control the switches/transistors are then brought to an increased voltage level $V_{dc}$ by means of level shifters 9, 10, 12 powered by the internal voltage increase circuit.

Figure 8:
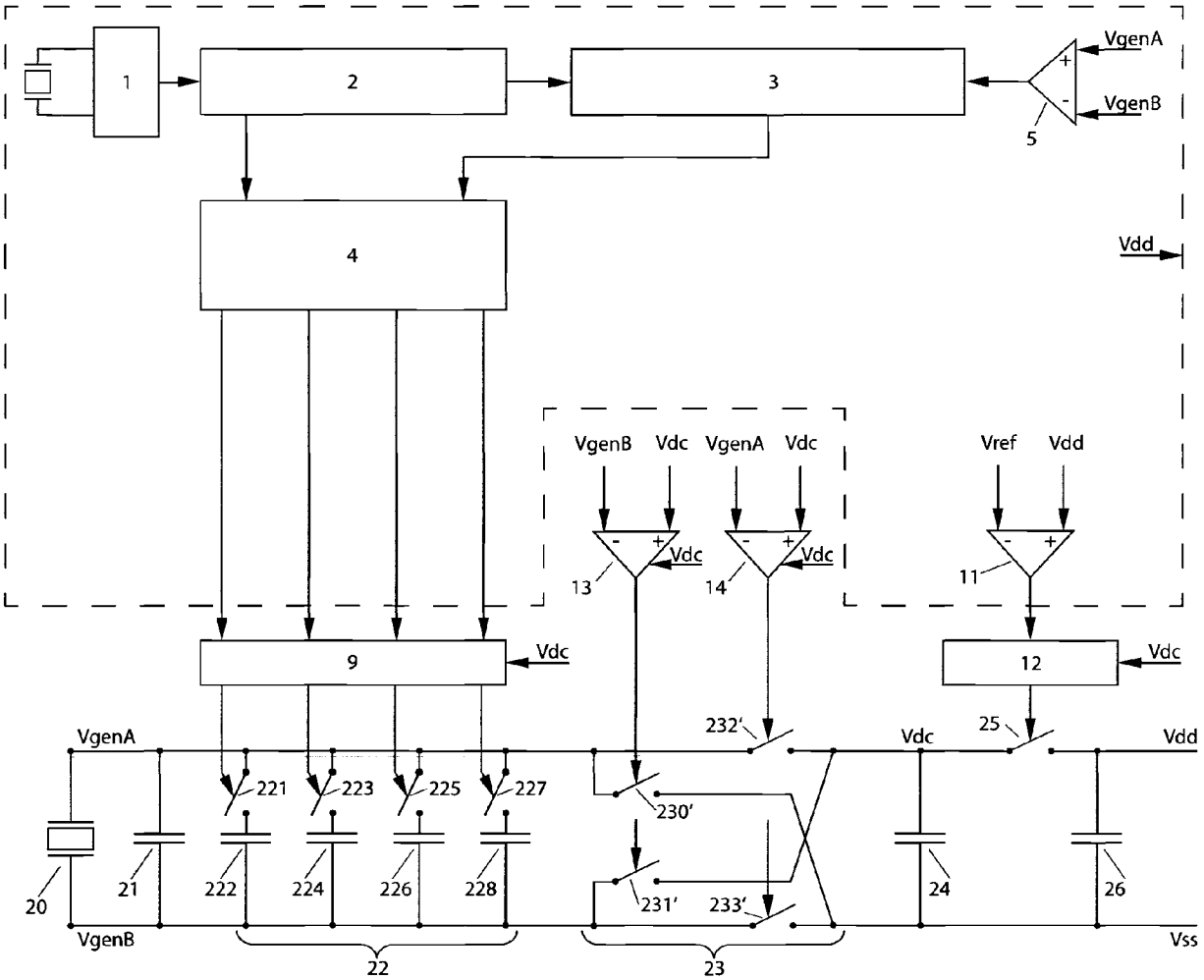
FIG. 8 shows a diagrammatic view of the electronic circuit, wherein only the switches for the frequency controller as well as the switch for the voltage controller of the second capacitance are controlled through level shifters.

There is however also the possibility of operating the comparators 13, 14 for the commutator with the higher voltage $V_{dc}$ from the first capacitance 24 after the commutator 23 (see FIG. 8). The switches 230' to 233' for the commutator 23 can then be controlled directly through the comparators 13, 14, furthermore no level shifters are then required for the commutator, in this case.

Controlling the Switching Transistors for Changing the Impedance with a Higher Voltage than the Feed Voltage Vdd of the IC 40

If the resistance over the switches 221, 223, 225, 227 that connect or cut off the capacitances 222, 224, 226, 228 is to big, for example 1 MOhm or more, the electric losses are considerable and the oscillation amplitude of the balance then becomes much too small. It is no longer possible to ensure that the clockwork movement operates effectively.

In order to make sure of achieving an electric resistance that is as low as possible over the switching transistors 221, 223, 225, 227, at least one P-channel transistor and one N-channel transistor per switch are connected in parallel. These transistors are controlled over level shifters 9, which as described above must be powered with a sufficiently high voltage $V_{dc}$, in order to connect or cut off the capacitances 222 to 228. The logic signals from the comparator-logic circuit 4, which control the switches/transistors, are thus brought up to a higher voltage level by means of the level shifters 9, which are powered either by the higher voltage $V_{dc}$ at the output of the first capacitance or by an internal voltage-increase circuit.

Limitation of the Maximum Amplitude

In the case of clockwork movements with an automatic winding-up mechanism, it can happen that the mainspring is wound up too strongly and accordingly a torque that is too high is delivered to the clockwork movement. A high torque of the mainspring generates a great amplitude in the balance. Too large an amplitude is however not desired. In the case of a clockwork movement provided with a piezo spiral hairspring 40, a large amplitude results in a large induced voltage and thus in a relatively large voltage at the capacitance 24 powered by the commutator 23. However, as soon as this capacitance is charged, for example if a resistance is connected in parallel to the capacitance, the voltage at the capacitance will sink and the piezo spiral hairspring will be subjected to a greater load. This results in the oscillation amplitude of the balance becoming smaller, which in this case is indeed desired. It is thus sufficient to measure the voltage at the first capacitance 24 after the commutator 23 and, in the event of a particular voltage being exceeded, to connect a resistance (not represented) in parallel to the capacitance 24 in order to thus restrict the amplitude.

Minimizing the Power Consumption of the Comparators

Comparators are used for measuring different signals. Since mechanical oscillators have already stabilized the system to a large extent, the times are known at which the different values are needed. It is thus possible to work with a reduced number of comparators. The inputs and outputs of the comparators are then switched differently depending on the phase.

A further possibility consists in switching certain comparators off when they are not needed. This will also save power. If for example the comparator 5 for ensuring the sign change of the induced voltage of the piezo generator (zero crossing) is switched off after the switching process for 1/16 of a second, since the next zero crossing will take place only after 1/8 of a second (balance with 4 Hz), it is possible to save power. The clockwork movement will however still continue to function, since the oscillating frequency has been stabilized to a large extent by the balance/spiral hairspring.

After the comparators have been switched on, they need a certain amount of time until the desired working point is reached. In order to prevent the comparators from supplying false signals during this time span, the output of the respective comparator is only activated if the working point of the corresponding comparator has been reached. This can be achieved by activating the output of the comparator only after a predetermined time span has passed after the comparator has been switched on.

Power-On-Reset (POR)

A Power-on-Reset circuit (short: POR), not represented, ensures that the electronic control circuit 40 can be reliably initiated, does not require too large a starting current and also does not remain caught in the start-up process. In doing so, those elements that are needed for the respective phase of the start-up process are gradually activated or those elements that are not required at that moment are deactivated or some elements are also put into a start-up mode.

In order for the electronic control circuit 40 to be initiated reliably, it is necessary to ensure that when starting-up the circuit, the active commutator 23 is shifted into a start-up mode as long as the quartz oscillator 1 is not operational yet. The POR serves to operate the commutator 23 with the comparators and the switches (for example field effect transistors) even whilst the oscillator 1 is not functioning.

At the very beginning of the start-up phase, some of the switches 230' to 233' function as simple diodes and in this phase at least one capacitance 24 is charged over these diodes associated with a loss. As soon as the internal power source on the IC is operational, the comparators also start to function. In this phase, the switches are then controlled directly by the comparators.

In order to have an AC voltage favorable for the starting-up of the electronic circuit, the POR can also be used to connect, during the start-up phase, one or several capacitors 222 to 228 in parallel to the piezo spiral hairspring 20. The induced voltage can thus be set to a particular value favorable for the starting-up of the electronic circuit 40. As soon as the quartz oscillator 1 is operational and the POR disappears, it is possible again to use the connecting and cutting off of the capacitances 222 to 228 to control the oscillation frequency of the balance.

The POR furthermore serves to ensure the quartz oscillator 1 is reliably initiated and to make sure that when the quartz oscillator 1 is started, not too much power is required. This can be achieved by first charging at least one capacitance 24 with the aid of the commutator, first with the passive elements (diodes) and, as soon as the power source is started, with the active elements (comparators and switches). Only when the capacitance powering the quartz oscillator is charged to a minimum voltage, for example 1V, is the quartz oscillator 1 started. In doing so, the current can reach 200 nA during one second. This however is not a problem since the main part of the electric power is supplied by the already charged capacitance. For a capacitance of 1 uF and 1V, this then yields a voltage drop of approx. 0.2V. In this way, it is possible to ensure a reliable starting-up of the quartz oscillator without the balance/spiral hairspring system being subjected to too strong a load by a high start-up current.

Thanks to the POR, it is also possible to ensure that the second capacitance 26 is supplied during the start-up process by the first capacitance 24 with sufficient electric energy. It is also possible to feed the quartz oscillator 1 exclusively through the second capacitance 26 and to start the oscillator 1 only as soon as the second capacitance has reached a certain minimum voltage.

The POR further serves to start regulating the oscillation frequency of the balance in a particular control state. If the regulating assembly operates with the aid of a counter in the comparator-logic circuit 4, the POR can for example first put the counter or counters into a particular state A, in order then, when the POR disappears, to be put into the state B and activated.

Furthermore, with the POR, the comparators 7, 8, (13, 14) for the commutator 23 are connected in such a way that during the start-up process the comparators 7, 8 (13, 14) are always switched on and operational, and only when the POR disappears are the comparators switched on and off at certain times to save energy. It is also possible to only operate the comparators for the commutator 23 in the start-up phase and switch on the further comparators 5, 11 only later in the course of the start-up process, as soon as they are needed.

The signal POR depends on the internal power source and on the quartz oscillator 1 as well as, if desired, also on the voltage on at least one capacitance. As long as the power source does not supply sufficient current, a signal of a PORA will be 1, and as long as the frequency of the quartz oscillator does not reach a predetermined value, the signal of a PORB will also be 1. And as long as the voltage at one capacitance has not reached a desired value, the signal of a PORC will also be 1. The signal POR can consist of PORA, PORB, PORC and signals from the frequency divider and the logic part of the electronic circuit; additionally to this, signals from the analog part of the electronic circuit can also be used. It is however also possible for different POR to be formed from the signals described above.

Miniaturization of the Electronic Circuit

The electronic circuit is preferably designed to be so small that it can be easily placed and hidden in the clockwork movement under a bridge.

Ideally, this occurs by replacing the balance bridge of a conventional mechanical clockwork movement including the balance and the spiral hairspring. The electronics 40 must now additionally be placed into the clockwork movement. It can be advantageous to place the electronics in such a way that they are no longer visible, for example under the balance bridge. In order for this to be feasible, the electronics must be designed as small as possible. In the ideal case, the electronic regulating circuit can even be integrated directly into the balance bridge.

This can be achieved by executing the entire electric circuit 40, with the exception of the external capacitances and of the external oscillation quartz 1, as one integrated electronic circuit 400. In order to save even more space, the chip 40 can be mounted with the flip-chip assembly technique directly, without further connecting leads, with the active contact side facedown—towards the substrate/circuit board. This results in particularly small dimensions of the housing and small conductor lengths. The entire surface of the dies (of the chip) can thus be used for contacting.

The dimensions of the individual, commercially available component elements have for example the following measurements:

IC/chip 40 1×1.52×1.03×0.4 mm

Quartz 1 1×2.0×0.0×0.6 mm

Capacitor 2×1.0×0.5×0.5 mm

Capacitor 3×0.4×0.2×0.2 mm

The elements are so small that they can be lodged on a printed circuit 400 of approx. 3.35×2.3 mm, and this even if the elements are mounted only on one side. It would indeed be possible to fit the elements also on both sides of the printed circuit. Or there is also the possibility of using a flexible printed circuit and then to bend the printed circuit so that capacitors come to rest on one another.

Figure 3A:
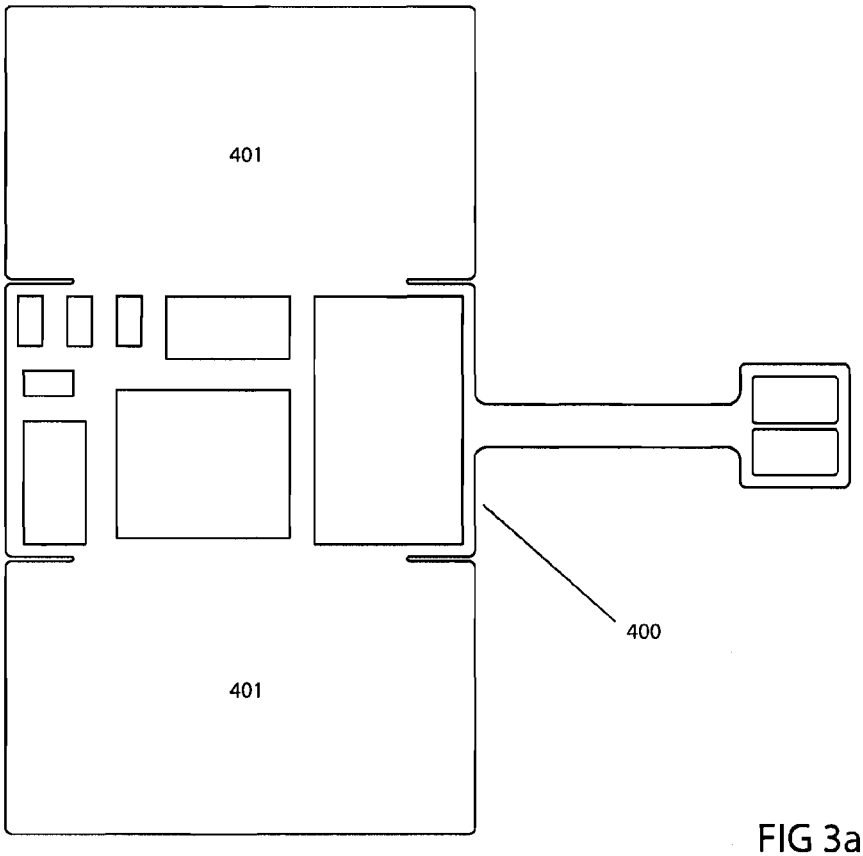
FIG. 3*a* shows a diagrammatic view of the printed circuit with the component elements soldered on, wherein in addiction to the electronic circuit, there are large surfaces on which test pads or test contacts can be affixed.
Figure 3B:
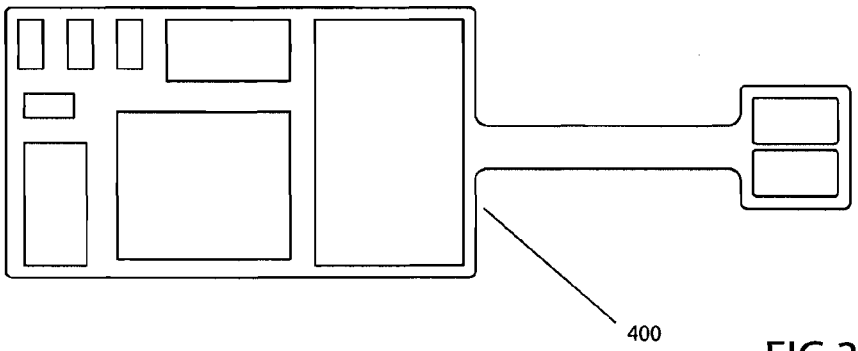
FIG. 3*b* shows a diagrammatic view of the printed circuit with the component elements soldered on, wherein the test surfaces are separated.

On such a small module, the space is however very limited, there is practically only enough space for the electronic components. Test pads for the testing of the electronic circuit cannot be placed on such a small printed circuit board. Furthermore, arranging the conductor paths for connecting the elements to one another is also nearly impossible. This problem can be solved, on the one hand, by the PCB having conductor paths on both sides and these being connectable continuously with one another through the board. It is thus possible on the upper side of the printed circuit board to solder a number of very small capacitors, which establish electric connections to the other elements but are arranged on the underside of the printed circuit board. This, however, will not yet solve the problem of the test pads. This can be solved by arranging the test pads 401 on an additional part of the printed circuit board 400 (FIG. 3*a*, 3*b*). This part of the printed circuit board 400 is then separated after the electronic has been successfully tested. The test pads 401 can thus be designed generously, which makes subsequent testing easier. Since this part however is separated after the successful testing, the final printed circuit board 400 has only very small dimensions.

Another possibility for saving space consists in making the printed circuit board 400 at least partly of a flexible material. The connectors 300 for the piezo spiral hairspring 20 can thus be designed as a thin long extension of the printed circuit board 400. It is therefore no longer necessary to solder onto the printed circuit board wires that then establish the electric connection to the piezo spiral hairspring 20. The function of the wires is taken on by the thin long extension of the flexible printed circuit board. This has the additional advantage that after the electronic components have been affixed onto the printed circuit board and after the subsequent testing, only the connection to the piezo spiral hairspring 20 needs to be established. These are only two electric connections that can be established with soldering or with electrically conductive glue. The electric connection could however also be established by bonding.

On the printed circuit 400 under the IC 40 on both sides of the printed circuit, copper is to be provided. No light can thus penetrate through the printed circuit and impair the functional efficiency of the IC.

A further possibility is to use a multi-layer flexible printed circuit board 400, for example with 3 layers. The electric connection between the individual layers is established through vertical contactings. On the topmost layer, the contacts to the IC, to the capacitances, to the quartz and to the piezo spiral hairspring are arranged. In the middle layer, the connections between the contact points of IC, quartz, capacitances and the piezo generator are established, and the third layer can be used in order to execute a lightproof barrier under the IC. It is thus possible to omit a solder-resist, and the first and the third full-surface layer can be first nickel-plated and subsequently gold-plated.

In order to ensure an effective functioning of the electronic circuit, the electronic circuit after separation of the test pads is coated with a thin electric insulating protective layer, for example with a lacquer that hardens under UV light. This will make it possible to prevent the electronic module from establishing an undesired electric contact with the clockwork movement or parts of the clockwork movement and thus from being impaired in its function.

In this manner, it is possible to execute an electronic module with a footprint that is as small as possible but also with a volume that is as small as possible.

It is however also conceivable not to remove the test pads 401 after the electronic has been tested but rather to fold the test pads so that they only take up little space under the electronic circuit 400.

If the electronic circuit is bent, there should be no coating with nickel at that place. Nickel is too hard and the print could break at that point. This problem can be solved with a triple-layered flexible printed circuit, by executing the electric connection to the piezo spiral hairspring through the middle sheet or layer.

The entire electronic module is thus very small and can be hidden without any problem under a bridge or a similar component part. This has the additional advantage that the electronics will then be protected from light, from electric fields and from magnetic fields. According to the invention, it would be advantageous to place the electronics under the balance bridge. An inventive clockwork movement will thus look practically like a purely mechanical clockwork movement but has the advantage of a considerably better precision.

Determining the Control Range

The possibility of the control electronics indicating when the frequency of the balance no longer lies in the control range of the electronics can be useful for the watchmaker. When the balance oscillates too slowly, the electronics can for example display that the control range has been exhausted, by changing the oscillation frequency of the quartz. This can happen by internal capacitances of the integrated circuit 40 being connected or cut off at the connectors of the quartz oscillator 1. Exactly the same can happen when the balance oscillates too quickly and no longer lies within the control range. For example, the frequency of the quartz oscillator can be increased if the balance oscillates too slowly and outside the control range of the electronics. Conversely, the frequency of the quartz oscillator can be slowed down if the balance oscillates too quickly and outside the control range of the electronics. The watchmaker can thus determine, simply by measuring the frequency of the quartz oscillator, whether the electronics can correctly regulate the oscillating frequency of the balance.

Connection of the Piezo Spiral Hairspring 20 to the Electronic Circuit 40

The electric connection 300 from the piezo spiral hairspring 20 to the electronic circuit 40 must be designed in such a way that this connection is not subjected to a mechanical load by the oscillation of the balance.

This can be done for example by providing the end 30 of the spiral hairspring 20 with a widened part 280. This widened part is then no longer subjected to any deformations when the balance oscillates back and forth and the spiral hairspring is deformed. The mechanical fastening of the spiral hairspring can also be effected at this widened part, be it through screws, clamps or gluing. And the electric connection to the electronic circuit can be executed through soldering, gluing with an electrically conductive glue (Adhesive Conducting Glue or Adhesive Conduction Paste) or through bonding; an electric connection is also conceivable that is executed with mechanical means, for example with clamps.

A further possibility consists in extending the spiral hairspring 20 in such a way that the end 280 of the piezo spiral hairspring 30 extends over the small blocks, so that the electric connection 300 between the piezo spiral hairspring 20 and the electronic circuit 40 can be established at the end that is not subjected to mechanical load. This can be done for example by soldering, as long as the Curie temperature of the piezo electric material is not exceeded during the process.

Another variant is to design the small block in such a way that at the front part the piezo spiral hairspring 20 is held mechanically and absorbs the oscillations, whilst at the rear part the electric contact is established between the electrodes of the piezo materials and the electronic circuit 40. The electrodes can be applied with the CVD (Chemical Vapor Deposition) process onto the piezo material. Alternatively, the electrodes can be applied by means of sputtering technique or with a galvanic process.

With a clockwork movement according to the invention, all complications known for mechanical watches such as automatic winding up, date, phase of the moon, chronograph etc. can be executed. The difference to a conventional mechanical clockwork movement is only in the execution of the regulating assembly resp. controller. All other component elements are identical to those of a mechanical watch.

The inventive clockwork movement can be constructed in such a way that the final customer may chose whether he/she desires a conventional mechanical balance or balance that is additionally regulated electronically. In this case, the balance and the spiral hairspring of the inventive clockwork movement are designed differently, but the lever and lever wheel can remain the same although they may also possibly be modified. The bearing zones on the other hand are the same. The electronics can be integrated for example in the balance bridge. This ensures that the bottom plate of the clockwork movement is the same for both kinds of watches, be it a purely mechanical or an additionally electronically regulated one. In this manner, a higher added value can be generated for the same capital expenditure.

Combining the Balance and Piezo Spiral Hairspring

Since they are produced separately, the balance and spiral hairspring need to be adapted to one another. It is very important to manufacture the spiral and the balance accurately, in order for the moment of inertia of the balance and the moment of the spiral hairspring to be capable of being adapted to one another.

This method consists in combining a balance with the appropriate spiral hairspring. The balances, already balanced, are grouped in several, e.g. twenty, classes according to their moments of inertia.

The piezo spiral hairsprings are also divided in several, for example twenty, classes on the basis of their respective moment.

The thus classified balances and spiral hairsprings can then be associated to one another according to their classes.

Since the oscillation frequency of the balance can be modified by means of the controller electronics in a range of about 1%, it is possible by carefully measuring the balance and piezo spiral hairspring and subsequently assembling them, to control the exact oscillation frequency of the balance only by means of the small auxiliary electronics. In the ideal case, the watchmaker thus has nothing more to do in respect of the regulating aspect.

It is also makes sense to measure not only the mechanical properties of the piezo spiral hairspring but also the electric properties such as for example the induced voltage depending on the amplitude of the balance, the inner resistance of the piezo spiral hairspring and the electric capacitance of the piezo spiral hairspring. This will allow mechanically faultless but electrically defective spiral hairsprings to be eliminated.

The invention claimed is:

1. A method for controlling the oscillation frequency of a piezo-electric hairspring in a clockwork movement, comprising:

regulating the oscillation frequency of the piezo-electric hairspring by adjusting a capacitance connected in parallel with said piezoelectric hairspring, wherein said capacitance comprises a plurality of capacitances that can be either one of connected to and cut off from said piezoelectric hairspring.

2. The method according to claim 1, wherein the oscillation frequency is regulated by either one of individually connecting and cutting off said plurality of capacitances.

3. The method according to claim 2, wherein a combination of the capacitances that are either one individually connected and cut off is determined by a size of a phase shift between a frequency of a balance wheel and a reference frequency.

4. The method according to claim 1, wherein said plurality of capacitances are either connected or cut off when a voltage created by said piezoelectric hairspring is lower than a predetermined threshold.

5. The method according to claim 1, wherein said plurality of capacitances are either connected or cut off when a current generated by said piezoelectric hairspring is lower than a predetermined threshold.

6. The method according to claim 1, wherein each capacitance of said plurality of capacitances being either connected and cut off individually through a respective switch.

7. The method according to claim 6, wherein a control voltage of said respective switch is as high as a voltage applied to the switch.

8. The method according to claim 6, wherein said respective switch is connected through a level shifter.

9. The method according to claim 7, said respective switch is controlled by an electronic circuit, wherein the control voltage of said respective switch is higher than a feed voltage for components in the electronic circuit.

10. The method according to claim 1, wherein a capacitance is permanently connected in parallel with the piezo electric hairspring.

11. The method according to claim 1, further comprising rectifying a voltage induced by said piezoelectric hairspring with a rectifier, wherein said rectifier comprises diodes that are replaced after start-up by switches, and a control voltage of said switches is approximately as high as a commutated voltage.

12. The method according to claim 11, wherein said switches in said rectifier are switched over a level shifter.

13. The method according to claim 1, wherein one input of a comparator-logic circuit is connected with an electronic reference circuit, wherein another input of the comparator-logic circuit is connected with the piezoelectric hairspring, wherein the comparator-logic circuit compares a clock signal from an electronic reference circuit with a clock signal originating from the piezoelectric hairspring, and depending on the result of this comparison, controls the number of capacitances connected in parallel to the piezoelectric hairspring and therefore controls the running of a time display, and wherein at least one comparator is switched off during each period.

14. The method according to claim 1, wherein when starting-up an electronic circuit, a particular combination of capacitances in said plurality of capacitances is connected in parallel to the piezoelectric hairspring through a Power On Reset POR signal in order to achieve an induced voltage of the piezoelectric hairspring that is favorable for the starting-up of the electronic circuit.

15. The method according to claim 3, wherein said phase shift is determined based on a first large counter and of a second small counter.

16. The method according to claim 15, a counter read at the output of the second small counter after a down pulse has been received is temporarily stored and used later to connect or cut off said plurality of capacitances.

17. A regulating element for a clockwork movement, comprising:

a balance wheel that oscillates with an oscillation frequency around a balance axis;

a piezo-electric spiral hairspring connected with the balance wheel that generates a voltage depending on the oscillations of the balance wheel and of the piezoelectric spiral hairspring;

an electronic circuit as auxiliary regulating element, for adapting a stiffness of the piezo electric hairspring in order to regulate the oscillation frequency of the balance wheel;

wherein the electronic circuit comprises at least one capacitance connected in parallel to the piezoelectric spiral hairspring, and wherein said capacitance comprises a plurality of capacitances that can be either one of connected to and cut off from said piezoelectric hairspring.

18. The regulating element according to claim 17, wherein said at least one capacitance comprises a plurality of individually connectable capacitances.

19. The regulating element according to claim 17, wherein the auxiliary regulating element comprises a rectifier circuit for rectifying a voltage generated by the piezoelectric spiral hairspring, wherein at least one first capacitive component element at least immediately after a first starting-up of the clockwork movement is charged through a passive component element or through passive component elements and the passive component element, respectively the passive component elements can be replaced with an active component unit as soon as the voltage of the first capacitive component element is sufficient for operating the active component unit, and wherein the active component unit has a smaller electric resistance in forward-biased direction than the passive component element.

20. The regulating element according to claim 19, further comprising switches, for switching on said capacitances; and a level shifter, for controlling said switches with an increased voltage.

21. The regulating element according to claim 17, further comprising a flexible printed circuit board to connect the piezo-electric spiral hairspring with the electronic circuit.

* * * * *